US008602534B2

(12) United States Patent
Takemoto

(10) Patent No.: US 8,602,534 B2
(45) Date of Patent: Dec. 10, 2013

(54) LIQUID DROPLET EJECTING HEAD, LIQUID DROPLET EJECTING DEVICE, AND IMAGE FORMING APPARATUS

(75) Inventor: Takeshi Takemoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 183 days.

(21) Appl. No.: 13/233,469

(22) Filed: Sep. 15, 2011

(65) Prior Publication Data

US 2012/0069102 A1 Mar. 22, 2012

(30) Foreign Application Priority Data

Sep. 16, 2010 (JP) ..... 2010-207424
May 17, 2011 (JP) ..... 2011-110172

(51) Int. Cl.
*B41J 2/045* (2006.01)

(52) U.S. Cl.
USPC ..... 347/70; 347/68; 347/71; 347/72; 347/50

(58) Field of Classification Search
USPC ..... 347/68, 70–72, 50
See application file for complete search history.

(56) References Cited

U.S. PATENT DOCUMENTS

| | | | |
|---|---|---|---|
| 6,367,914 | B1 | 4/2002 | Ohtaka et al. |
| 7,905,573 | B2 | 3/2011 | Takemoto et al. |
| 2010/0302323 | A1 | 12/2010 | Yagi et al. |

FOREIGN PATENT DOCUMENTS

| | | |
|---|---|---|
| JP | 2004-82650 | 3/2004 |
| JP | 3580363 | 7/2004 |
| JP | 2005-349712 | 12/2005 |
| JP | 3988042 | 7/2007 |

OTHER PUBLICATIONS

U.S. Appl. No. 13/229,880, filed Sep. 12, 2011, Kida, et al.

*Primary Examiner* — Matthew Luu
*Assistant Examiner* — Henok Legesse
(74) *Attorney, Agent, or Firm* — Oblon, Spivak, McClelland, Maier & Neustadt, L.L.P.

(57) ABSTRACT

In an embodiment, a liquid droplet ejecting head includes sequentially in a laminated manner: a nozzle substrate; an ink tank substrate; a liquid supply substrate; and a frame substrate. The nozzle substrate is formed so that at least three or more nozzle rows are arranged in a direction intersecting a longitudinal direction of the nozzle row; the driving circuit member is provided to oppose to an outer surface of the frame substrate so as to correspond to a region between two adjacent nozzle rows located at the 4N+2-th position and the 4N+3-th position (N is 0 or a natural number); and the driving circuit member is commonly used to drive the electro-mechanical converting element and to drive the electro-mechanical converting element used for another one or two nozzle rows adjacent to at least one of the two nozzle rows.

18 Claims, 10 Drawing Sheets

LIQUID DROPLET EJECTING HEAD, LIQUID DROPLET EJECTING DEVICE, AND IMAGE FORMING APPARATUS

CROSS-REFERENCE TO RELATED APPLICATIONS

The present application claims priority to and incorporates by reference the entire contents of Japanese Patent Application No. 2010-207424 filed in Japan on Sep. 16, 2010 and Japanese Patent Application No. 2011-110172 filed in Japan on May 17, 2011.

BACKGROUND OF THE INVENTION

1. Field of the Invention

The present invention relates to a liquid droplet ejecting head such as an inkjet head which ejects an ink droplet, and a liquid droplet ejecting device and an image forming apparatus which include the liquid droplet ejecting head.

2. Description of the Related Art

In recent years, an inkjet printer (also referred to as a liquid droplet ejecting device) having inkjet heads (also referred to as liquid droplet ejecting heads) mounted thereon is increasingly used due to its advantages of high quality, low cost, and fast responsiveness (capable of responding to fast printers and slow-and-cheap printers with the number of nozzles being increased or decreased). Amid such trend, demands for further improvement of image quality and further reduction in cost and size are required.

As a method of forming the inkjet head, micro electromechanical systems (MEMS) is introduced. This is a microfabrication technique using a semiconductor process.

For example, components such as an ink tank, a vibration plate, a piezoelectric element, and an electrode necessary for the inkjet head may be formed on a silicon substrate by processing techniques such as etching and sputtering. However, the head may be made to be smaller in size by decreasing the sizes of the components or studying the arrangement of the components. As a result, many inkjet heads may be obtained from one silicon substrate (semiconductor substrate), and cost may be reduced in accordance with a decrease in size.

In decreasing the size of the inkjet head, it is a crucial issue to compactly mount a driving IC driving the piezoelectric element provided in the inkjet head in addition to the components such as the ink tank, the vibration plate, the piezoelectric element, and the electrode.

FIG. 11 is a diagram illustrating a configuration of an existing inkjet head.

As shown in FIG. 11, the inkjet head of conventional arts includes a head body 200 including a nozzle substrate 201 provided with a nozzle hole ejecting an ink droplet as a liquid droplet, an ink tank substrate 202 provided with an ink tank receiving an ink ejected from the nozzle hole due to a pressure applied thereto with a bending operation of a vibration plate and a piezoelectric element, a liquid supply substrate 203 supplying an ink to the ink tank, and a frame substrate 204; wherein the head body 200 is electrically connected, by soldering or anisotropic conductive film (ACF) bonding, with a flexible printed circuit board (FPC) 206 to which a driving IC 205 for driving the piezoelectric element of the ink tank substrate 202 is bonded. In the inkjet head with this configuration, the FPC 206 oscillates in a flapping manner with the operation of the head, or there is a problem in the strength of the bonding portion between the FPC 206 and the head body.

For this reason, handling is not easy and a decrease in size is not realized due to an increase in volume as a whole.

In order to solve such a problem, a configuration is proposed in which a driving IC is mounted on a head body.

For example, Japanese Patent Application Laid-open No. 2005-349712 discloses a configuration in which a partition wall defines the outside of an ink pool chamber (common ink tank) on the layer flush with the ink pool chamber, and a driving IC is disposed in a space provided between a vibration plate and a ceiling plate in the width direction (substrate thickness direction). The driving IC is provided to correspond to each of a plurality of nozzle rows, and is bonded to a metallic interconnection of a piezoelectric element substrate provided with a piezoelectric element through a predetermined height of bump.

Further, Japanese Patent No. 3988042 discloses a configuration in which a sealing substrate is laminated on a passage forming substrate provided with a nozzle with a pressure generating chamber or the like interposed therebetween, and a piezoelectric element is disposed in a space defined from a reservoir (common ink tank) of the sealing substrate. A driving IC is provided to correspond to each of a plurality of nozzle rows, and is bonded to a surface of the sealing substrate located above the piezoelectric element.

Further, Japanese Patent No. 3580363 discloses a configuration in which a driving IC is bonded to a front surface of a bonding member provided in a piezoelectric element holding portion defined from a reservoir (common ink tank) on the layer flush with the reservoir. The driving IC and the piezoelectric element are interconnected to each other through a bonding wire drawn outward from the driving IC and passing through a gap between the reservoir and the piezoelectric element holding portion.

SUMMARY OF THE INVENTION

It is an object of the present invention to at least partially solve the problems in the conventional technology.

According to an aspect of the present invention, there is provided a liquid droplet ejecting head including sequentially in a laminated manner a nozzle substrate including a plurality of nozzles; an ink tank substrate including a plurality of ink tanks respectively communicating with the nozzles, vibration plates each forming a part of each ink tank, and a plurality of electromechanical converting elements integrally formed with the vibration plates, respectively so as to correspond to the ink tanks, respectively; a liquid supply substrate including a plurality of liquid supply paths respectively supplying a liquid to the ink tanks; and a frame substrate including common ink tanks communicating with each liquid supply path, wherein an electrode of a driving circuit member driving the electro-mechanical converting elements is connected to each electrode of the plurality of the electro-mechanical converting elements through an interconnection member; the nozzle substrate is formed so that at least three or more nozzle rows, each nozzle row including the plurality of nozzles, are arranged in a direction intersecting a longitudinal direction of the nozzle row; the driving circuit member is provided to oppose to an outer surface of the frame substrate so as to correspond to a region between two adjacent nozzle rows located at the 4N+2-th position and the 4N+3-th position (N is 0 or a natural number) in an arrangement direction among the plurality of nozzle rows arranged in the direction intersecting the longitudinal direction of the nozzle row; and the driving circuit member is commonly used to drive the electromechanical converting element used for the two nozzle rows and to drive the electro-mechanical converting element used for another one or two nozzle rows adjacent to at least one of the two nozzle rows.

According to another aspect of the present invention, there is provided a liquid droplet ejecting device including the liquid droplet ejecting head mentioned above.

According to further another aspect of the present invention, there is provided an image forming apparatus including a liquid droplet ejecting device including the liquid droplet ejecting head mentioned above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, exemplary embodiments will be specifically described with reference to the accompanying drawings.

Figure 1:
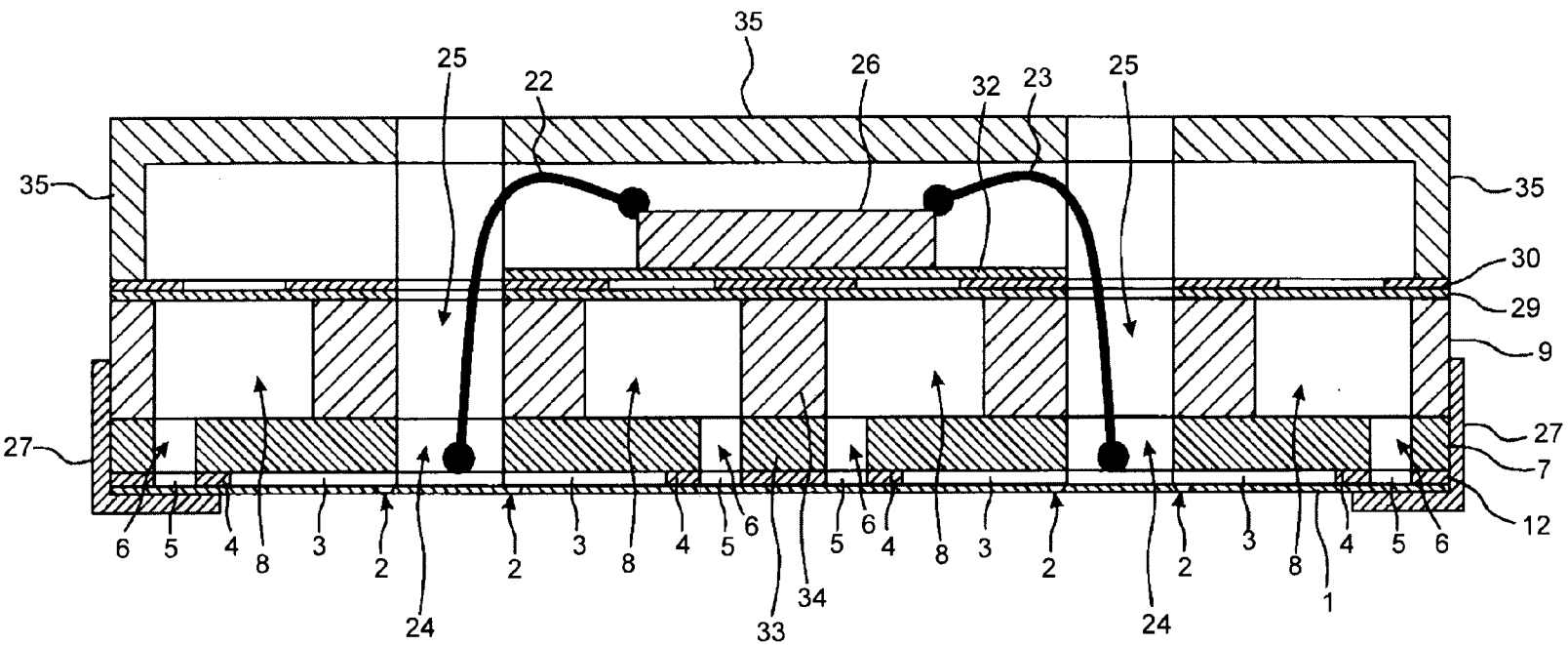
FIG. 1 is a schematic configuration diagram of an inkjet head according to an embodiment.
Figure 2:
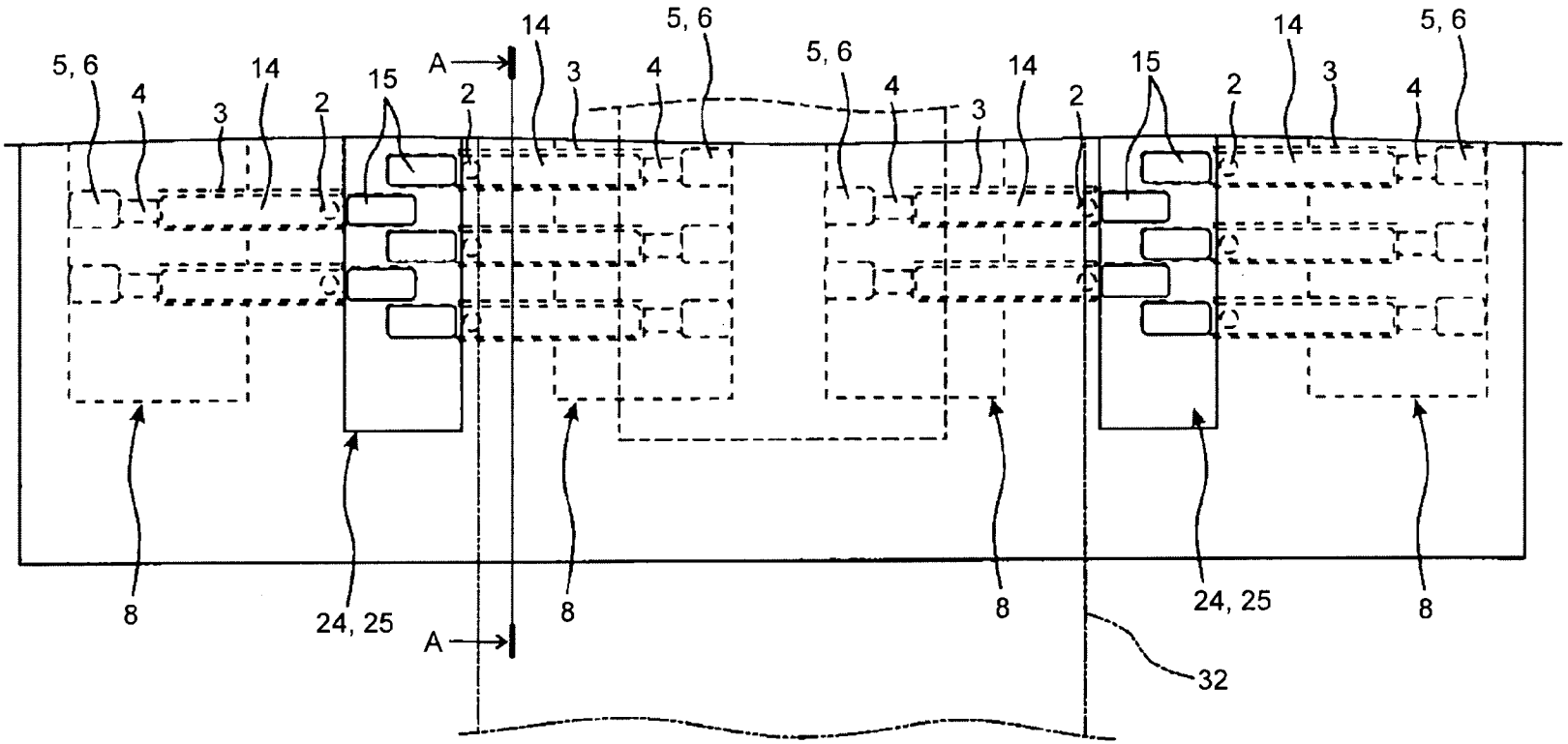
FIG. 2 is a plan view transparently showing a longitudinal end of the inkjet head of FIG. 1.
Figure 3:
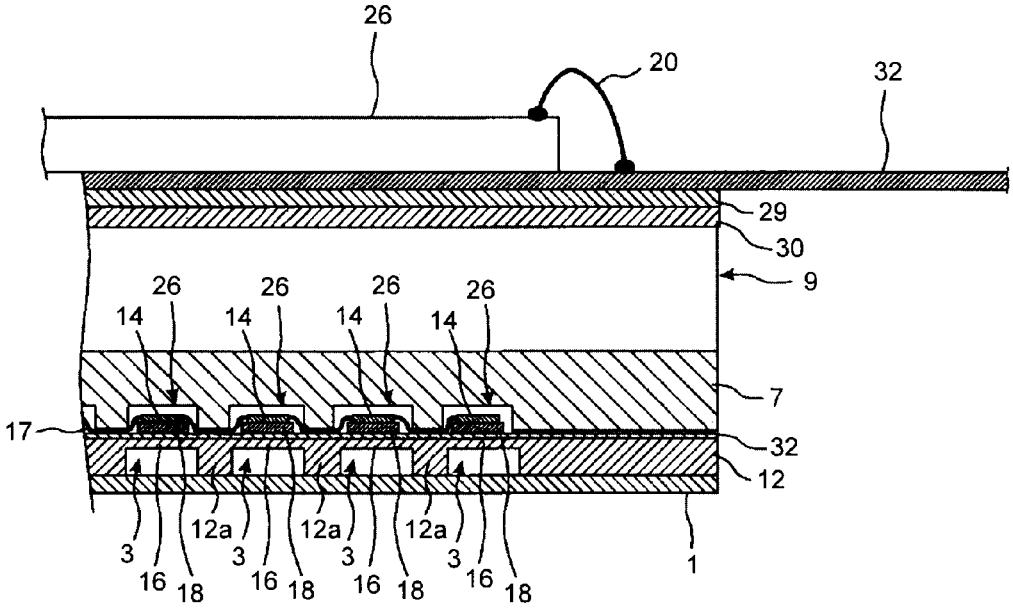
FIG. 3 is a cross-sectional view taken along the line A-A of FIG. 2.

FIG. 1 is a schematic configuration diagram of an inkjet head as a liquid droplet ejecting head according to an embodiment. FIG. 2 is a schematic view visibly showing the longitudinal end of the inkjet head of FIG. 1. FIG. 3 is a cross-sectional view taken along the line A-A of FIG. 2, and is a diagram mainly illustrating a specific configuration around a piezoelectric element and an ink tank.

As shown in FIG. 1, an inkjet head according to the embodiment is formed by sequentially laminating an ink tank substrate 12 provided with a plurality of ink tanks 3 respectively communicating with nozzles 2; a liquid supply substrate 7 provided with ink supply grooves 6 serving as liquid droplet supply paths for supplying an ink as a liquid forming a liquid droplet to the ink tanks 3 through ink inlet paths; and a frame substrate 9 provided with common ink tanks 8 respectively communicating with the ink supply grooves 6 on a nozzle substrate 1 provided with the plurality of nozzles 2.

The ink tank substrate 12 includes ink inlet paths 5 respectively communicating with the ink supply grooves 6 of the liquid supply substrate 7 and a fluid resistance portion 4 provided between each ink inlet path 5 and each ink tank 3. Further, as shown in FIG. 3, the ink tank substrate 12 includes vibration plates 16 each constituting a part of each ink tank 3 and piezoelectric elements 18 each serving as an electro-mechanical converting element integrally formed with the vibration plate 16. An upper electrode 14 is bonded to an upper surface of the piezoelectric element 18; and a common lower electrode 13 is bonded to a lower surface of the piezoelectric element 18. An insulating layer 17 is formed between the upper electrode 14 and the lower electrode 13. Further, since the piezoelectric element 18 and the upper electrode 14 are formed on the ink tank substrate 12 to protrude toward the liquid supply substrate 7, concave portions 26 are formed at corresponding positions of the liquid supply substrate 7 so as not to interfere with the piezoelectric elements 18 and the upper electrodes 14 in space. Further, as shown in FIG. 3, the plurality of ink tanks 3 of the ink tank substrate 12 is individually defined by side walls 12*a* integrally formed with the ink tank substrate 12.

The frame substrate 9 is provided on the liquid supply substrate 7 to be located at the opposite side to the ink tank substrate 12. Driving ICs 26 serving as driving circuit members respectively driving the piezoelectric elements 18 are provided to face the outer surface of the liquid supply substrate 7 at the opposite side to the frame substrate 9 of the head body. More specifically, a buffer thin plate 29 and a thin film frame substrate 30 are further laminated on the frame substrate 9 at the opposite side to the liquid supply substrate 7; and a driving IC 26 is bonded onto the thin film frame substrate 30 through an FPC 32 as a printed circuit board. The buffer thin plate 29 is a member that reduces a pressure fluctuation generated in the common ink tank 8. Further, the thin film frame substrate 30 also serves as a damper frame substrate; and an FPC 31 having the driving IC 26 bonded thereto is bonded to the upper portion through an appropriate interconnection.

An electrode pad of the driving IC 26 and a pad 15 provided at the end of each upper electrode 14 of the plurality of piezoelectric elements 18 are connected to each other through wires 22 and 23 serving as interconnection members. The wires 22 and 23 are disposed to respectively pass through openings 24 and 25 formed to penetrate the liquid supply substrate 7, the frame substrate 9, the buffer thin plate 29, and the thin film frame substrate 30. Further, the electrode pad of the driving IC 26 and the electrode pad of the FPC 32 are connected to each other through a wire 20 serving as an interconnection member.

When a predetermined voltage is applied from a driving IC 11 to the piezoelectric element 18 through the wires 22 and 23, a pressure may be generated in the ink tank 3. For example, when an image signal is input to the driving IC 26, the driving IC 26 applies a voltage to each piezoelectric element 18 on the basis of the image signal, and deforms the vibration plate 16 integrally formed with the ink tank substrate 12 to be connected to the piezoelectric element 18. The deformed vibration plate 16 generates a pressure in ink filled in the ink tank 3. Ink is ejected from the nozzle 2 due to the pressure generated inside the ink tank 3, so that an image may be recorded on a recording sheet.

Further, in the inkjet head of the embodiment, the nozzle substrate 1 is formed so that four nozzle rows, each including a plurality of nozzles, are arranged in the direction intersecting the longitudinal direction of the nozzle row (the longitudinal direction of the inkjet head). That is, four nozzle rows are formed in the lateral direction (the direction intersecting the longitudinal direction of the inkjet head) of FIG. 1 so that a plurality of nozzles is formed at a predetermined interval in the direction (the longitudinal direction of the inkjet head) perpendicular to the paper surface of FIG. 1. Likewise, since all nozzles constituting four nozzle rows are integrally formed with the nozzle substrate 1, the positional precision increases and the image quality improves.

Further, in the embodiment, the driving IC 26 is provided while facing the outer surface of the frame substrate 9 to correspond to a region between two adjacent nozzles rows located at the 4N+2-th position and the 4N+3-th position (N is 0 or a positive integer) in the arrangement direction (the direction intersecting the longitudinal direction of the inkjet head) among four nozzle rows arranged in the lateral direction of FIG. 1. More specifically, the driving IC 26 is disposed while facing the outer surface of the frame substrate 9 to correspond to the region between two adjacent nozzle rows (two nozzle rows at the center side of the drawing) located at the second and third positions in the arrangement direction of four nozzle rows. Furthermore, the driving IC 26 is commonly used to drive each piezoelectric element 18 used for two center side nozzle rows and drive each piezoelectric element 18 used for another two adjacent nozzle rows from the outside of the two nozzle rows. That is, in the case of the embodiment, a single driving IC 26 is used to drive each piezoelectric element 18 used for all four nozzle rows. Therefore, since four driving ICs in the conventional arts may be replaced by a single driving IC 26, a space for providing the driving IC 26 may be decreased, which may contribute to a decrease in size and a reduction in cost.

Further, in the embodiment, the ink tank 3 of the ink tank substrate 12, the ink supply groove 6 of the liquid supply substrate 7, and the common ink tank 8 of the frame substrate 9 respectively corresponding to two center side nozzle rows are respectively provided to overlap each other on a region obtained by projecting the driving IC 26 to each of the ink tank substrate 12, the liquid supply substrate 7, and the frame substrate 9. Furthermore, the plurality of ink supply grooves 6 provided adjacent to each other to correspond to the two center side nozzle rows is adjacent to each other with one partition wall 33 interposed therebetween. Further, the plurality of common ink tanks 8 provided adjacent to each other to correspond to two center side nozzle rows is also adjacent to each other with one center wall 34 interposed therebetween. With such a configuration, the size in the arrangement direction (the lateral direction of FIG. 1) of the four nozzle rows may be decreased. In particular, since the thickness of the center wall 34 defining two center side common ink tanks 8 may be substantially halved compared to the case where the common ink tank 8 and the peripheral structure thereof are individually provided for each nozzle row like the related art, the inkjet nozzle may be further decreased in size.

Further, in the inkjet head of the embodiment, a ceiling plate (protection frame) 35 is provided to protect the top surface side provided with the driving IC and the corners thereof. Further, a nozzle cover 27 is provided at the outer peripheral corners of the bottom surface side provided with the nozzle substrate 1 to protect the nozzle substrate from the contact with paper during a printing process and ensure a sealing property.

Next, referring to FIGS. 1 to 3, an exemplary process of manufacturing the inkjet head according to the embodiment and an example of a material of each component will be described.

The ink tank substrate 12 is formed of a silicon substrate; the lower electrode 13 is formed on one surface thereof by sputtering or the like; and the piezoelectric element 18 is formed thereon. The piezoelectric element 18 is patterned to have a predetermined length and a predetermined width. The insulating layer 17 is formed on necessary portions thereof; and the upper electrode 14 is formed on the piezoelectric element 18. Further, an electrode drawn portion of the upper electrode 14 is provided with the pad 15 (refer to FIG. 2) formed of gold.

Next, the liquid supply substrate 7 formed of a glass or silicon substrate is bonded to the ink tank substrate 12. An opening (notch) 24 is formed in advance in the liquid supply substrate 7 by etching or the like to expose the pad 15 on the ink tank substrate 12 and the ink supply groove 6.

The ink tank substrate 12 is processed and ground to be thinned up to a predetermined thickness on the basis of the liquid supply substrate 7. For example, it is desirable that the thickness of the ink tank substrate 12 be 100 μm or less.

Subsequently, an opening serving as the ink inlet path 5 is formed by etching or the like in the ink tank substrate 12 to communicate with the common ink tank 8 through the ink tank 3, the fluid resistance portion 4, and the ink supply groove 6. As shown in FIG. 2, the fluid resistance portion 4 serves as fluid resistance by making the width thereof smaller than that of the ink tank 3.

Next, the nozzle substrate 1 is bonded to the ink tank substrate 12, and the frame substrate 9 is bonded to the liquid supply substrate 7 at the opposite side to the ink tank substrate 12. The frame substrate 9 is provided with one ink inlet path for at least each nozzle row (the arrangement direction of the ink tanks 3).

Next, the buffer thin plate 29 and the thin film frame substrate 30 are bonded to the frame substrate 9; the driving IC 26 is bonded to the thin film frame substrate 30 through the FPC 32; and then the driving IC 26 and the pad 15 are bonded to each other through the conductive wires 22 and 23 serving as the interconnection member.

Furthermore, the procedure of bonding or wire-bonding the nozzle substrate 1, the frame substrate 9, and the driving IC 11 to each other may be appropriately changed.

It is desirable to bond the driving IC 11 to the FPC 32 by wire-bonding in order to further shorten the connection length (width). Further, the wire-bonding is a desirable bonding method even in a bonding method performed at a comparatively low bonding temperature. Further, as shown in FIG. 1, the wire-bonding may be best suitably used when there is a step between bonding subjects (interconnection places).

Further, the liquid supply substrate 7 may be formed of a silicon substrate, but may be formed of glass in order to reduce cost. For example, when sand-blasting is used, cost may be further reduced. Further, the frame substrate 9 may be formed of a glass substrate, but may be desirably formed of a resin in order to further reduce cost. However, since a considerably high temperature is applied when bonding the driving IC 26, particularly, a liquid crystal polymer, a PPS, or a heat-resistant resin such as an epoxy resin is more desirable.

Figure 4:
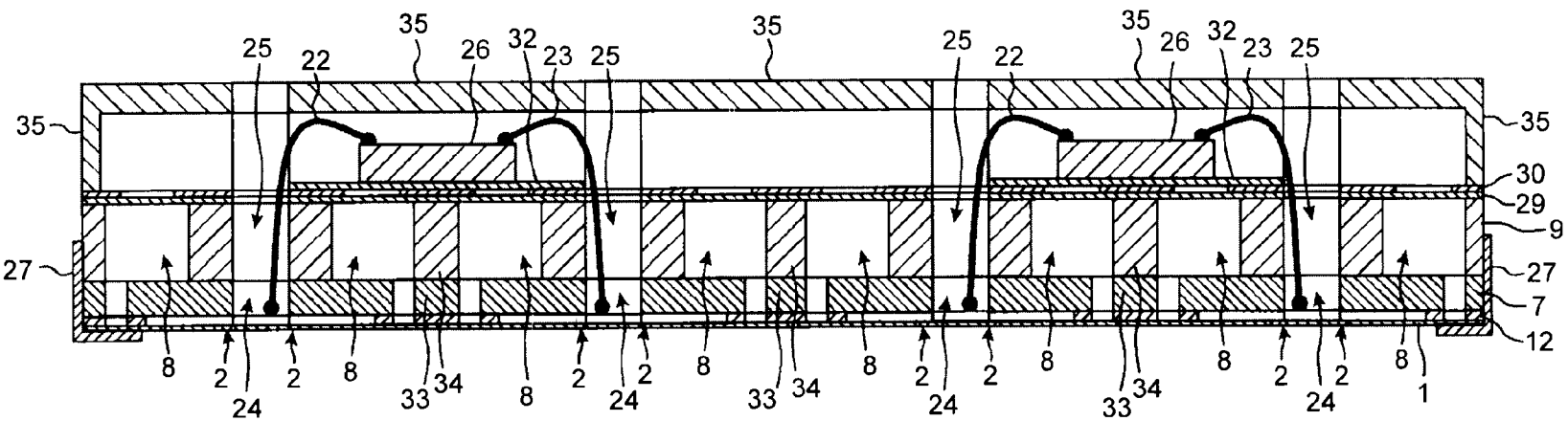
FIG. 4 is a schematic configuration diagram of an inkjet head according to another embodiment.

FIG. 4 is a schematic configuration diagram of an inkjet head serving as a liquid droplet ejecting head according to another embodiment. The same reference numerals will be given to the same components as those of the embodiment shown in FIGS. 1 to 3, and the detailed description thereof will not be repeated. In the inkjet head of FIG. 4, the nozzle substrate 1 is formed so that eight nozzle rows each including a plurality of nozzles are arranged. That is, eight nozzle rows are formed in the lateral direction (the direction intersecting the longitudinal direction of the inkjet head) of FIG. 1; so that a plurality of nozzles is formed at a predetermined interval in the direction (the longitudinal direction of the inkjet head) perpendicular to the paper surface of FIG. 4. Likewise, since all nozzles constituting eight nozzle rows are integrally formed with the nozzle substrate 1, the positional precision increases and the image quality improves.

Further, in the embodiment of FIG. 4, two driving ICs 26 are used. One of two driving ICs 26 is provided while facing the outer surface of the frame substrate 9 to correspond to the region between two adjacent nozzle rows (the second and third nozzle rows from the left side of the drawing) located at the second and third positions in the arrangement direction of eight nozzle rows arranged in the lateral direction (the direction intersecting the longitudinal direction of the inkjet head) of FIG. 4. Furthermore, the other driving IC 26 is provided while facing the outer surface of the frame substrate 9 to correspond to the region between two adjacent nozzle rows (the sixth and seventh nozzle rows from the left side of the drawing) located at the sixth and seventh positions in the arrangement direction of eight nozzle rows.

Each of the two driving ICs 26 is commonly used to drive each piezoelectric element 18 used for all four nozzle rows. That is, the left driving IC 26 of the drawing is used to commonly drive each piezoelectric element 18 used for all four nozzle rows located at the first to fourth positions from the left side of the drawing; and the right driving IC 26 of the drawing is used to commonly drive each piezoelectric element 18 used for all four nozzle rows located at the fifth to eighth positions from the left side of the drawing. Therefore, since eight existing driving ICs may be replaced by two driving ICs 26, a space for providing the driving IC 26 may be decreased, which may contribute to a decrease in size and a reduction in cost. Further, since the other configurations of the inkjet head of FIG. 4 are the same as those of the embodiment shown in FIGS. 1 to 3, the same effect may be obtained as the inkjet head of the embodiment of FIGS. 1 to 3.

Figure 5:
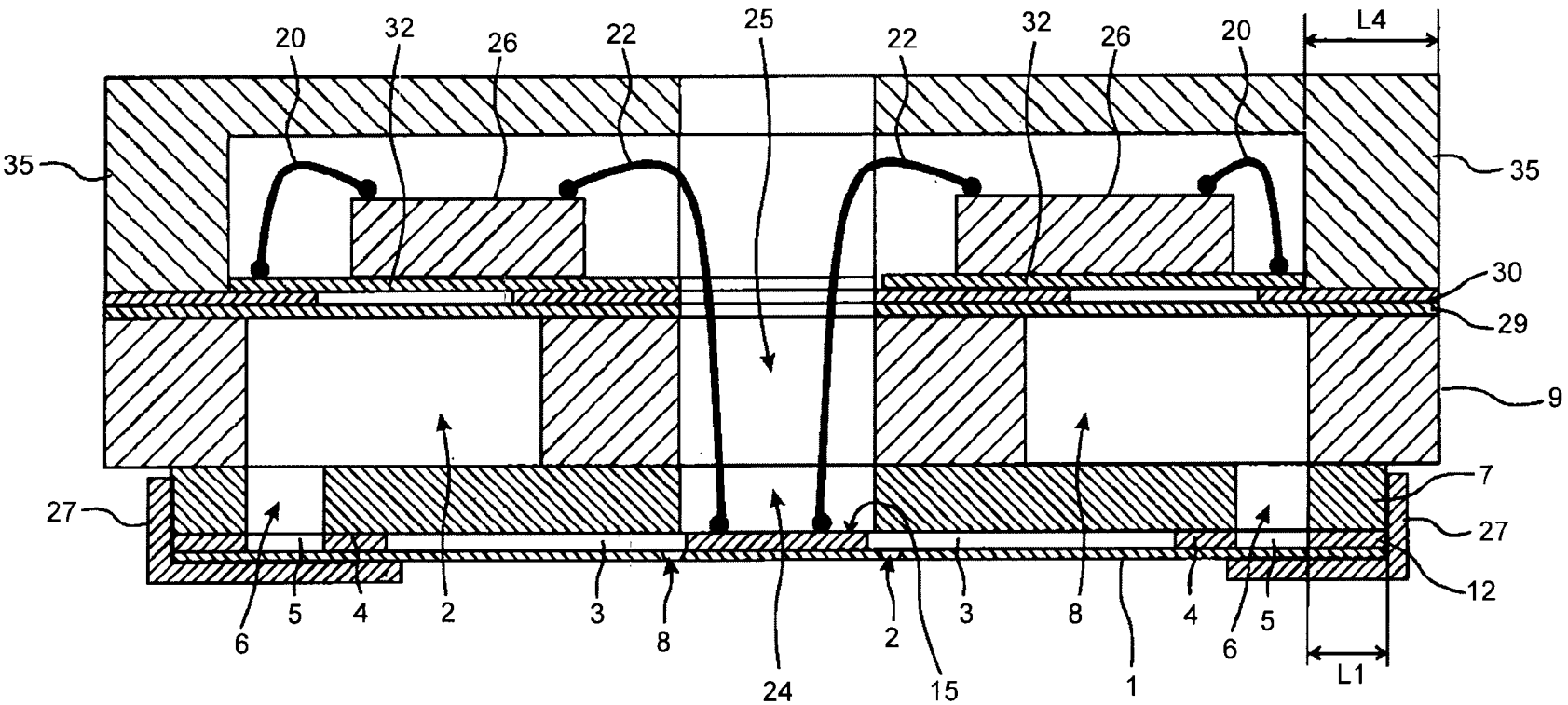
FIG. 5 is a schematic configuration diagram of an inkjet head according to still another embodiment.

FIG. 5 is a schematic configuration diagram of an inkjet head serving as a liquid droplet ejecting head according to still another embodiment. Furthermore, the same reference numerals will be given to the same components as those of the embodiment shown in FIGS. 1 to 4, and the detailed description thereof will not be repeated.

In the inkjet head according to the embodiment, two nozzle rows are formed on the nozzle substrate 1. Further, in order to bond the piezoelectric element 18 formed in the ink tank substrate 12 to the driving IC 26, openings 25 and 24 are respectively provided at the center portions of the frame substrate 9 and the liquid supply substrate 7, and the pad 15 and the driving IC 26 are bonded to each other through the wire-bonding from the center portion of the ink tank substrate 12. Further, the plurality of driving ICs 26 is provided for the piezoelectric elements respectively corresponding to the ink tanks with the opening 25 of the frame substrate 9 interposed therebetween, and the pad 15 is bonded to each driving IC 26. The common ink tank 8 is provided in the frame substrate 9 to be disposed on the bonding surface with the liquid supply substrate 7, and the common ink tank 8 and the ink supply groove 6 communicate with each other.

Further, the buffer thin plate 29 and the thin film frame substrate 30 are further laminated on the frame substrate 9 at the opposite side to the liquid supply substrate 7; and the driving IC 26 is bonded onto the thin film frame substrate 30 through the FPC 32. Furthermore, since an opening is provided in the FPC 32 to correspond to the opening 25 of the frame substrate 9, the wire-bonding between the driving IC 26 and the pad 15 of the center portion of the ink tank substrate 12 is not disturbed.

Further, the nozzle cover 27 is bonded to the outer peripheral ends of the nozzle substrate 1, the ink tank substrate 12, and the liquid supply substrate 7 to protect the components from the contact with paper during a printing process and ensure a sealing property. Further, the ceiling plate (protection frame) 35 is provided to protect the top surface side provided with the driving IC and the corners thereof.

Further, in the inkjet head of FIG. 5, for example, the following material is used as the material of respective layers. The nozzle substrate 1 is formed of a stainless plate (for example, a thickness of 50 μm), and the ink tank substrate 12 and the liquid supply substrate 7 are formed of a silicon wafer as a semiconductor substrate. Further, the frame substrate 9 is formed by laminating and adhering three stainless plates (for example, a thickness of 0.4 mm); and the buffer thin plate 29 is formed of a polyimide film (for example, a thickness of 25 μm). Further, the thin film frame substrate 30 is formed of a stainless plate (for example, a thickness of 0.1 mm); and the ceiling plate 35 is formed of a molding product from a PPS resin. In the case of such a configuration, the shortest bonding margin may be set in the case of the bonding margin between silicon wafers, that is, the ink tank substrate 12 and the liquid supply substrate 7. However, the length of the bonding margin L1 required for ensuring a sealing property may be determined in the case of the bonding margin between the nozzle substrate 1 (stainless plate) and the ink tank substrate 12 (silicon wafer).

Therefore, in the embodiment, the lengths of the substrates are set to become longer; and the bonding margins are set to sequentially become longer as it goes from the nozzle substrate 1 to the upper portion. That is, a relation of $L1<L4$ is satisfied when the low margin from the liquid supply substrate 7 formed of a silicon wafer is set to L1 and the bonding margin from the upper frame substrate 9 to the ceiling plate 35 is set to L4. With this configuration, since the bonding margins from the frame substrate 9 to the ceiling plate 35 are lengthened, the sealing property may be ensured. Further, since the lengths of the ink tank substrate 12 and the liquid supply substrate 7 which are expensive are set to be shorter than those of the other substrates (from the frame substrate 9 to the ceiling plate 35), the sealing property may be ensured, and an increase in cost may be drastically suppressed.

Furthermore, in the configuration example of the inkjet head of FIG. 5, the liquid supply substrate 7 is formed of a semiconductor substrate (silicon wafer). However, the liquid supply substrate 7 may be formed of a substrate other than the semiconductor substrate. For example, the liquid supply substrate 7 may be formed of a glass substrate (glass wafer).

Figure 6:
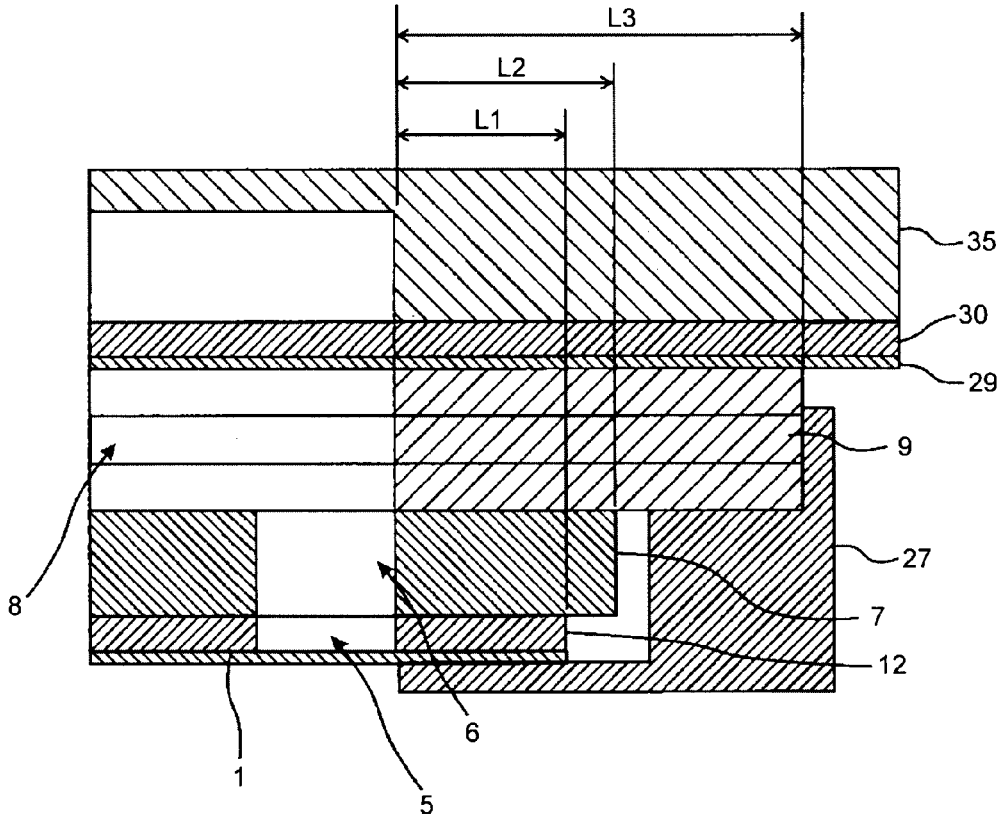
FIG. 6 is a schematic configuration diagram of the inkjet head according to still another embodiment.

FIG. 6 is a schematic configuration diagram of an end of an inkjet head serving as a liquid droplet ejecting head according to still another embodiment. Furthermore, the same reference numerals will be given to the same components as those of the embodiments shown in FIGS. 1 to 4 and 5; and the detailed description thereof will not be repeated.

Even in the inkjet head of the embodiment, like the configuration of FIG. 5, the lengths of the substrates are set to become longer, and the bonding margins are set to sequentially become longer as it goes from the nozzle substrate 1 to the upper portion.

In particular, in the embodiment, the relations of $L1 \leq L2 \leq L3$ and $L1<L3$ are satisfied when the length of the bonding margin between the substrates formed of semiconductor substrates is set to L1; the length of the bonding margin between the substrate formed of a semiconductor substrate and the substrate formed of the material other than the semiconductor substrate is set to L2; and the length of the bonding margin between the substrates formed of the material other than the semiconductor substrate is set to L3. More specifically, as shown in FIG. 6, the relations of L1≤L2≤L3 and L1<L3 are satisfied when the length of the bonding margin between the ink tank substrate 12 and the liquid supply substrate 7 formed of silicon wafers as semiconductor substrates is set to L1; the length of the bonding margin between the liquid supply substrate 7 formed of a silicon wafer and the frame substrate 9 formed of a stainless plate is set to L2; and the length of the bonding margin between the frame substrate 9 and the buffer thin plate 29 formed of a polyimide film is set to L3. Likewise, since the bonding margins are set to sequentially become longer as it goes to the upper portion, the sealing property between the frame substrate 9 and the buffer thin plate 29 may be ensured. In particular, since the lengths of the ink tank substrate 12 and the liquid supply substrate 7 which are expensive may be set to be shorter than those of other substrates, the sealing property may be ensured, and an increase in cost may be drastically suppressed.

Further, in the inkjet head of FIG. 6, since the bonding margins become longer as it goes to the upside of the drawing (as it goes from the frame substrate 9 near the lowermost surface to the ceiling plate 35 near the uppermost surface) in consideration of a decrease in cost, a decrease in size, and adhesiveness of a material of forming each substrate as described above, a slope is gradually formed at the ends of the laminated substrates as shown in the drawing. By using the slope formed at the ends of the substrates, large chamfering may be performed on the nozzle cover 27 in accordance with the slope. As one of functions of the nozzle cover 27, the head body is prevented from being broken due to colliding with the sheet when conveying the sheet used to form an image thereon. For this reason, even in the configuration in which the sheet is conveyed to the end of the head body without substantially increasing the head body, it is possible to prevent the head body from colliding with the sheet which is being conveyed and convey the sheet to a predetermined recording position by using the large chamfered portion formed at the nozzle cover 27 as in the embodiment of FIG. 6.

Furthermore, in the configuration example of the inkjet head of FIG. 6, the liquid supply substrate 7 is formed of the semiconductor substrate (silicon wafer). However, the liquid supply substrate 7 may be formed of a substrate other than the semiconductor substrate. For example, the liquid supply substrate 7 may be formed of a glass substrate (glass wafer).

Figure 7A:
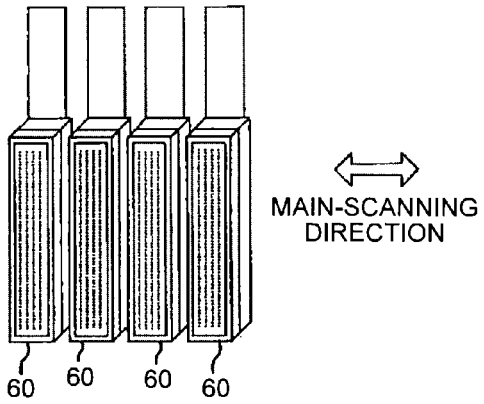
FIGS. 7A and 7B are diagrams respectively illustrating examples in which the inkjet head according to the embodiment is mounted on a printer.
Figure 7B:
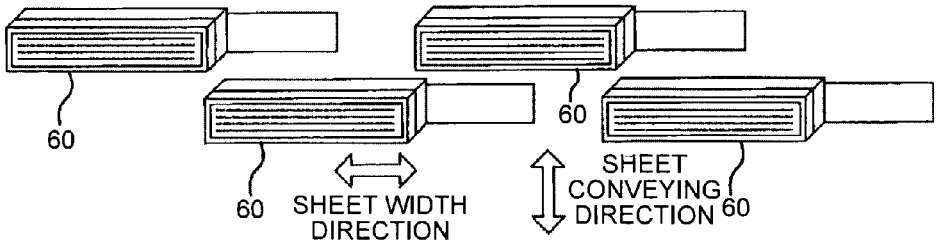

FIGS. 7A and 7B are diagrams illustrating an example in which the inkjet head according to the embodiments is mounted on a printer.

In the case where the inkjet head is mounted on a serial printer, for example, four inkjet heads 60 respectively supplying inks C, M, Y, and Bk are arranged in the lateral direction of the inkjet head to be mounted on a carriage scanning the main-scanning direction as shown in FIG. 7A, where an image may be formed on paper or the like by ejecting an ink from each inkjet head 60 thereto in response to an image signal transmitted when the paper is conveyed in the sub-scanning direction and the carriage (not shown) having each inkjet head 60 mounted thereon moves in the main-scanning direction.

As widely known, the lateral dimension of the serial printer needs to be ensured at least twice the widths of the paper surface and the head unit (in this case, four inkjet heads). Therefore, the lateral width of the inkjet head is an important factor related to a decrease in size of the serial printer. When the inkjet head 60 according to the embodiment is used, the serial printer may be further decreased in size and be manufactured at low cost.

Further, in addition to the serial printer, as shown in FIG. 7B, a so-called line head unit may be configured in a manner such that a plurality of (in the example shown in the drawing, four) inkjet heads 60 according to the embodiment is arranged in series in the paper surface direction to record an image only by the paper feeding operation. In the line head unit, a head unit may be configured which is very narrow in the direction perpendicular to the paper surface direction. For this reason, in the case where four-color line head unit is configured, the head width in the paper conveying direction is very small, and the line printer may be decreased in size and be also manufactured as low cost.

Figure 8:
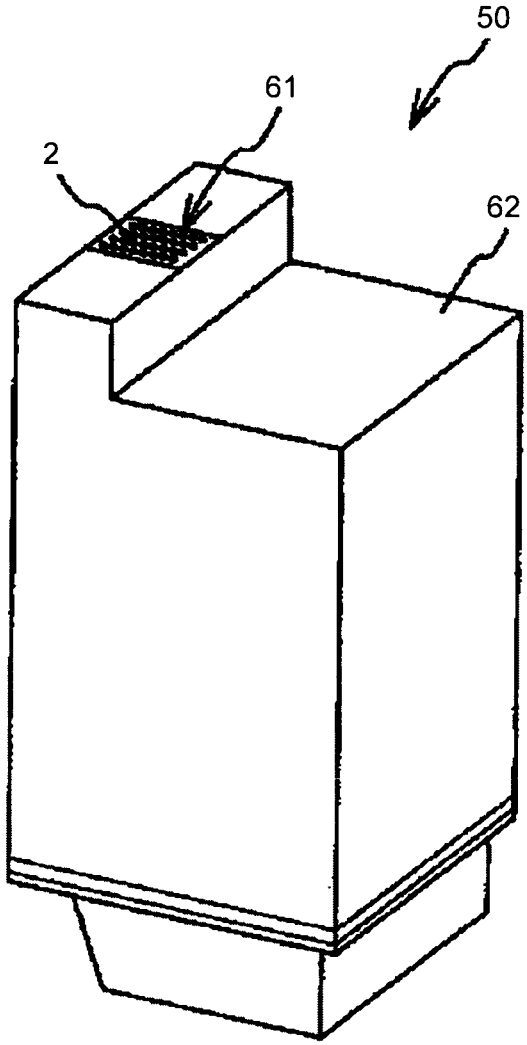
FIG. 8 is a schematic perspective view illustrating an ink cartridge adopting the inkjet head according to the embodiment.

FIG. 8 is a schematic perspective view illustrating an ink cartridge capable of adopting the inkjet head according to the above-described embodiments. An ink cartridge 50 is configured by integrating an inkjet head 61 with a nozzle hole 2 or the like according to any one of the above-described embodiments with an ink tank 62 supplying an ink to the inkjet head 61.

In particular, as shown in FIG. 7A, the ink cartridge may be mounted on the serial printer.

Likewise, in the case of the head integrated with the ink tank, since a decrease in cost and enhanced reliability of the head directly lead to a decrease in cost and enhanced reliability of the entire ink cartridge, a decrease in cost, high reliability, and a decrease in manufacture error may be realized as described above. Accordingly, the yield rate and the reliability of the ink cartridge improve, and the ink cartridge integrated with the head may be manufactured at low cost.

Figure 9:
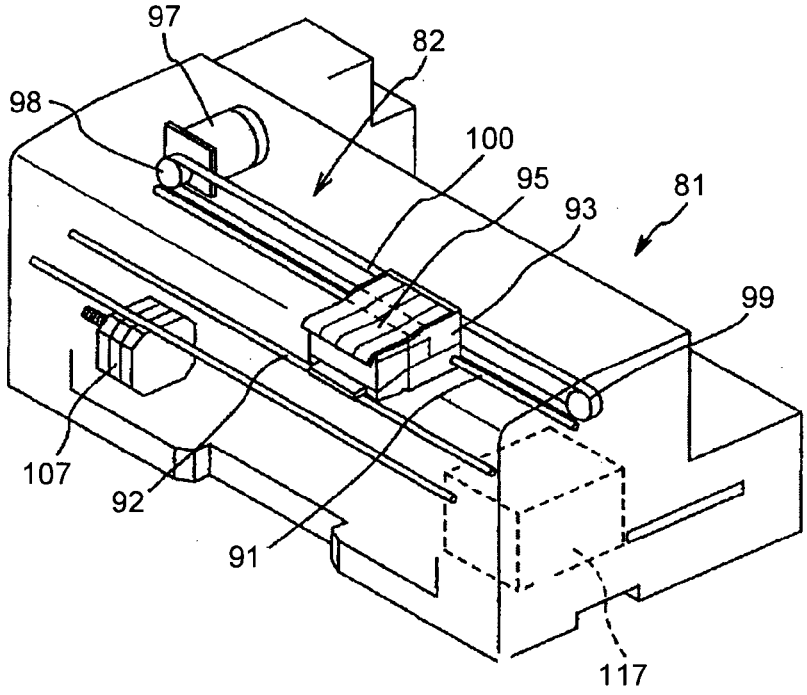
FIG. 9 is a perspective view illustrating an inkjet recording apparatus.
Figure 10:
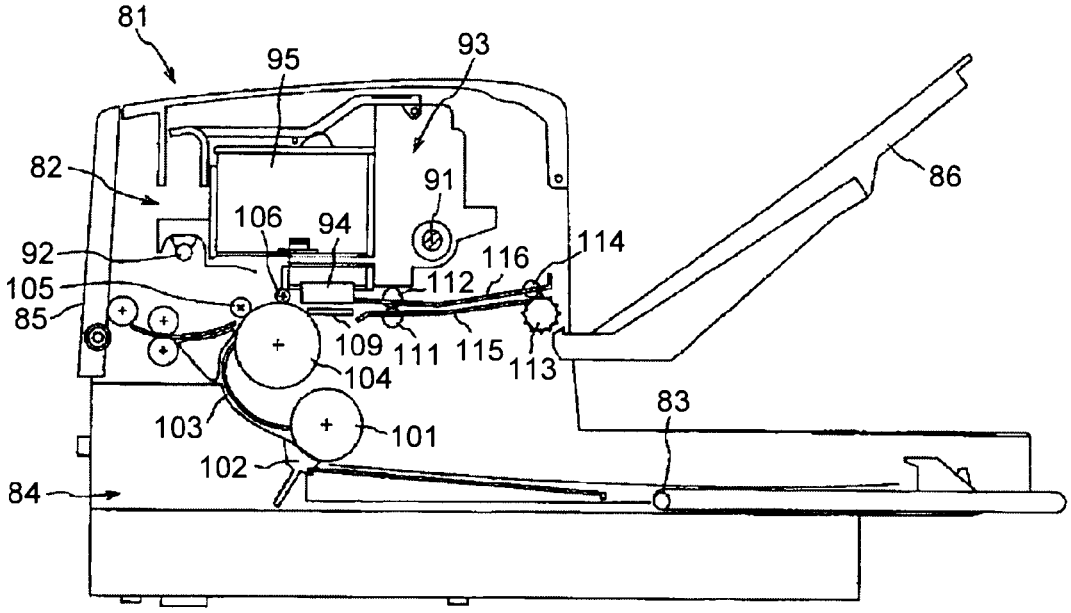
FIG. 10 is a side view of a mechanism of the inkjet recording apparatus.
Figure 11:
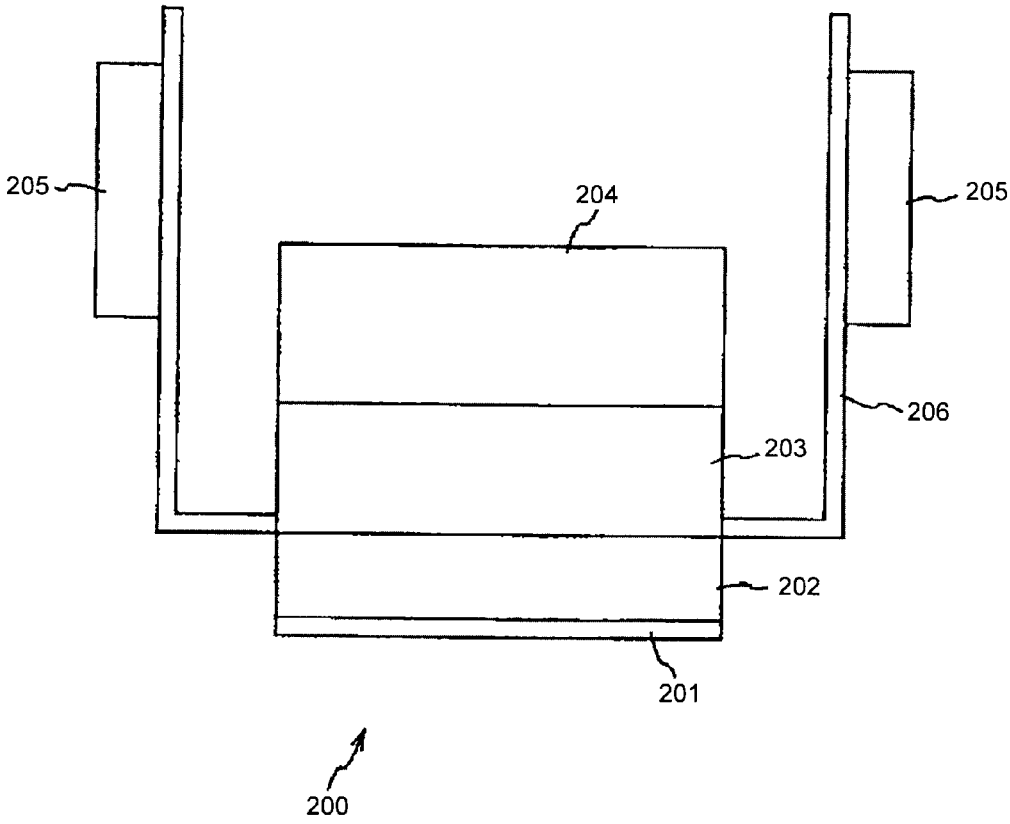
FIG. 11 is a diagram illustrating a configuration of a conventional inkjet head.

FIG. 9 is a perspective view illustrating an inkjet recording apparatus serving as an image forming apparatus capable of adopting the inkjet head according to the above-described embodiments. FIG. 10 is a side view of the mechanism of the inkjet recording apparatus of FIG. 9. In the inkjet recording apparatus, a recording apparatus body 81 receives a carriage 93 movable in the main-scanning direction, a recording head configured as the inkjet head mounted on the carriage 93, a printing mechanism 82 including an ink cartridge supplying an ink to the recording head, and the like.

A paper cassette (or a paper feed tray) 84 which stacks a plurality of sheets 83 thereon may be mounted on the lower portion of the recording apparatus body 81 so that the paper cassette is insertable to and extractable from the front side of the apparatus body. Further, a manual tray 85 for manually feeding the sheet 83 may be thrown down and opened. The sheet 83 fed from the paper cassette 84 or the manual tray 85 is received, a desired image is recorded thereon by the printing mechanism 82, and the sheet is discharged to a discharge tray 86 mounted on the rear side of the apparatus body.

The printing mechanism 82 holds the carriage 93 to be slidable in the main-scanning direction on a main-guide rod 91 and a sub-guide rod 92 serving as guide members suspended on left and right side plates (not shown).

Recording heads 94 configured as the inkjet heads ejecting ink droplets with respective colors, that is, yellow (Y), cyan (C), magenta (M), and black (Bk) according to the embodiment are mounted on the carriage 93 so that the plurality of ink ejecting ports (nozzles) are arranged in the direction intersecting the main-scanning direction and the ink droplet ejecting direction is directed downward. Further, each ink cartridge 95 supplying each color of ink to the head 94 is replaceably mounted on the carriage 93.

The ink cartridge 95 includes an atmosphere port provided at the upper portion thereof to communicate with an atmosphere, a supply port provided at the lower portion thereof to supply an ink to the inkjet head, and a porous body filled with an ink. The ink supplied to the inkjet head is maintained at a small negative pressure by the capillary force of the porous body. Here, the heads 94 ejecting respective colors of inks are used as the recording head, but a single head with a nozzle ejecting respective colors of ink droplets may be used.

Here, the rear side of the carriage 93 (at the downstream in the sheet conveying direction) is slidably fitted to the main-guide rod 91, and the front side thereof (at the upstream in the sheet conveying direction) is slidably placed on the sub-guide rod 92.

Then, in order to move and scan the carriage 93 in the main-scanning direction, a timing belt 100 is mounted between a driven pulley 98 and a driving pulley 99 rotationally driven by a main-scanning motor 97, the timing belt 100 is fixed to the carriage 93, and the carriage 93 is driven in a reciprocating manner by the normal and reverse rotation of the main-scanning motor 97.

On the other hand, in order to convey the sheet 83 set on the paper cassette 84 to the downside of the recording head 94, there are provided a paper feeding roller 101 and a friction pad 102 separating and feeding the sheet 83 from the paper cassette 84, a guide member 103 guiding the sheet 83, a carriage roller 104 reversely conveying the fed sheet 83, a carriage roller 105 pressed by the circumferential surface of the carriage roller 104, and a front end roller 106 defining a supply angle of the sheet 83 from the carriage roller 104. The carriage roller 104 is rotationally driven by a sub-scanning motor 107 through a gear set.

A print receiving member 109 as a sheet guide member is provided to guide the sheet 83, sent from the carriage roller 104 in accordance with the movement range of the carriage 93 in the main-scanning direction, at the downside of the recording head 94.

A carriage roller 111 and a spur 112 are provided at the downstream of the print receiving member 109 in the sheet conveying direction, and are rotationally driven to send out the sheet 83 in the discharge direction. Further, a discharge roller 113 and a spur 114 are provided to send out the sheet 83 to the discharge tray 86, and guide members 115 and 116 are disposed to form the discharge path.

During a recording operation, the recording head 94 is driven in response to an image signal while moving the carriage 93 to record an image for one pass on the stopped sheet 83 by ejecting an ink thereto; and the sheet 83 is conveyed by a predetermined amount to perform the next recording operation. When receiving a recording end signal or a signal indicating that the rear end of the sheet 83 reaches the recording region, the recording operation is ended and the sheet 83 is discharged.

Further, a recovery device 117 is disposed at a position deviated from the recording region of the rear end side of the carriage 93 in the movement direction to recover an ejection error of the recording head 94. The recovery device 117 includes a cap unit, a suction unit, and a cleaning unit which are not shown in the drawings.

In a printing standby mode, the carriage 93 moves to the recovery device 117 so that the recording head 94 is capped with the capping unit, and the ejecting port is maintained at a moisture state, so that an ejection error caused by dried ink may be prevented. Further, an ink regardless of the recording operation is ejected during a recording operation, so that the viscosity of ink of all ejecting ports is made to be constant, and a stable ejecting performance is maintained.

When an ejection error or the like occurs, the ejecting port (nozzle) of the recording head 94 is sealed by the capping unit, an ink and a bubble are suctioned from the ejecting port through a tube by the suction unit, and an ink or contaminants adhered to the surface of the ejecting port are removed by the cleaning unit, so that the ejection error is recovered. Further, the suctioned ink is discharged to a waste ink tank (not shown) provided at the lower portion of the body, and is absorbed and held in an ink absorbing body inside the waste ink tank.

Likewise, since the inkjet head according to the above-described embodiment is mounted on the inkjet recording apparatus, a manufacture error is reduced, a decrease in cost may be realized, and an ink droplet ejection error does not occur due to a vibration plate driving error. Accordingly, a stable ink droplet ejecting performance is obtained, and an image quality improves.

Furthermore, in the above-described embodiments, an example has been described which is applied to the inkjet head as the liquid droplet ejecting head. However, the embodiment may be applied to a liquid droplet ejecting head other than the inkjet head. For example, the embodiment may be applied to other liquid droplet ejecting heads such as a liquid droplet ejecting head that ejects a liquid resist as a liquid droplet and a liquid droplet ejecting head (spotter) the ejects a sample of DNA as a liquid droplet.

As described above, according to the embodiments shown in FIGS. 1 to 4 and FIGS. 7A to 10, the driving IC 26 is provided to correspond to a region between two adjacent nozzle rows located at the 4N+2-th position and the 4N+3-th position (N is 0 or a positive integer) in the arrangement direction intersecting the longitudinal direction of the nozzle row. Accordingly, the driving IC 26 may drive the plurality of piezoelectric elements from a position comparatively adjacent to the plurality of piezoelectric elements 18 corresponding to two nozzle rows and driven by the driving IC 26. Furthermore, the driving IC 26 is used to commonly drive not only the piezoelectric element 18 used for two nozzle rows, but also the piezoelectric element 18 used for another one or two nozzle rows adjacent to at least one of two nozzle rows. Therefore, one driving IC 26 may drive the plurality of piezoelectric elements 18 used for three or four nozzle rows, and a decrease in size and a reduction in cost may be realized compared to the case where the driving IC 26 is provided for each nozzle row. Furthermore, the common ink tank 8 communicating with each ink supply groove 6 of the liquid supply substrate 7 is formed in the frame substrate 9 different from the ink tank substrate 12 including the piezoelectric element 18, and the driving IC 26 is provided to face the outer surface of the frame substrate 9 provided with the common ink tank 8. Accordingly, since the common ink tank 8 may be formed in the frame substrate 9 without taking into consideration of the interference with the piezoelectric element 18 or the driving IC 26, the capacity of the common ink tank 8 is not easily limited by the piezoelectric element 18 or the driving IC 26. Therefore, a decrease in cost and a reduction in cost may be realized while ensuring the capacity of the common ink tank 8.

Further, according to the embodiment, the ink tank 3 of the ink tank substrate 12, the ink supply groove 6 of the liquid supply substrate 7, and the common ink tank 8 of the frame substrate 9 respectively corresponding to two nozzle rows are respectively provided to overlap each other on a region obtained by projecting the driving IC 26 to each of the ink tank substrate 12, the liquid supply substrate 7, and the frame substrate 9. With such a configuration, the size in the arrangement direction (the lateral direction of FIG. 1) of the nozzle rows may further be decreased.

Further, according to the embodiment, the plurality of ink supply grooves 6 and the plurality of common ink tanks 8 are provided adjacent each other with one partition wall (the side wall 33 and the center wall 34) interposed therebetween to correspond to the two nozzle rows. With such a configuration, the size in the arrangement direction (the lateral direction of FIG. 1) of the nozzle rows may be decreased. In particular, since the thickness of the center wall 34 defining two center side common ink tanks 8 may be substantially halved compared to the case where the common ink tank 8 and the peripheral structure thereof are individually provided for each nozzle row like the related art, the inkjet nozzle may be further decreased in size.

Further, according to the embodiment, the wires 22 and 23 serves as the interconnection members connecting the electrode of the driving IC 26 and each electrode of the plurality of piezoelectric element 18 to each other, and are respectively disposed to pass through the openings 24 and 25 formed to penetrate each of the liquid supply substrate 7, the frame substrate 9, the buffer thin plate 29, and the thin film frame substrate 30. Accordingly, the electrode of the driving IC 26 and each electrode of the plurality of piezoelectric element 18 may be connected to each other on a short interconnection path by a simple bonding method such as wire-bonding.

Further, according to the embodiment, the driving IC 26 is bonded to the thin film frame substrate 30 to face the outer surface of the frame substrate 9 with the FPC 32 interposed therebetween. Accordingly, an appropriate interconnection is performed on the upper portion of the thin film frame substrate 30, and the wired thin film frame substrate 30 may be bonded to the FPC 31.

Further, according to the embodiment, the buffer thin plate 29 and the thin film frame substrate 30 are further laminated on the frame substrate 9 at the opposite side of the liquid supply substrate 7. By using the buffer thin plate 29, a pressure fluctuation generated in the common ink tank 8 when ejecting an ink droplet may be reduced. Further, in the thin film frame substrate 30, an appropriate interconnection may be performed on a surface to be bonded to the FPC 31 as described above.

Further, according to the embodiment, in the configuration of using the nozzle substrate 1 provided with four nozzle rows, one driving IC 26 may be commonly used to drive all the plurality of piezoelectric elements 18 used for four nozzle rows.

Further, according to the embodiment, in the configuration using the nozzle substrate 1 provided with eight nozzle rows, each of the two driving ICs 26 may be commonly used to drive all the plurality of piezoelectric elements 18 used for four nozzle rows. Further, the plurality of ink supply grooves 6 and the plurality of common ink tanks 8 provided adjacent to each other with one partition wall interposed therebetween to correspond to two adjacent nozzle rows located at the fourth and fifth positions in the arrangement direction of eight nozzle rows. Likewise, since not only the plurality of ink supply grooves 6 and the plurality of common ink tanks 8 having two driving ICs 26 thereabove, but also the plurality of ink supply grooves 6 and the plurality of common ink tank 8 corresponding to the fourth and fifth nozzle rows and not having the driving IC 26 thereabove are provided adjacent to each other with one partition wall (the side wall 33 and the center wall 34) interposed therebetween, a size in the arrangement direction (the lateral direction of FIG. 1) of the nozzle rows may be further decreased.

Further, according to the embodiments shown in FIGS. 5, 6, and 7A to 10, in the bonding margins between the plurality of sequentially laminated substrates, the length of the bonding margin between substrates at least one of which is formed of a semiconductor substrate (silicon wafer) is set to be shorter than the length of the bonding margin between substrates formed of a material other than the semiconductor substrate. Accordingly, the length of the bonding margin between the semiconductor substrates with excellent adhesiveness is set to be relatively short to realize a decrease in size and a reduction in cost, and the length of the bonding margin between the substrates formed of a material other than the semiconductor substrate and having poor adhesiveness is set to be relatively long to ensure a sealing property between the substrates. Therefore, a decrease in size and a reduction in cost may be realized while ensuring a sealing property between laminated substrates as a whole.

Further, according to the embodiment, a relation of $L1 \leq L2$ is satisfied when the length of the bonding margin between the ink tank substrate 12 formed of a semiconductor substrate (silicon wafer) having excellent adhesiveness and the liquid supply substrate 7 formed of a semiconductor substrate or a material other than the semiconductor substrate is set to L1; and the length of the bonding margin between the liquid supply substrate 7 and the frame substrate 9 formed of a material other than the semiconductor substrate and having poor adhesiveness is set to L2. In this configuration, since the length of the bonding margin is relatively set in an order such that the liquid supply substrate 7 and the ink tank substrate 12 formed of the semiconductor substrate having excellent adhesiveness are bonded to each other and the liquid supply substrate 7 and the frame substrate 9 having poor adhesiveness are bonded to each other, a sealing property between the substrates may be ensured while realizing a decrease in size and a reduction in cost.

Further, according to the embodiment, a relation of $L1 \leq L2 \leq L3$ and $L1 < L3$ is satisfied when the length of the bonding margin between the frame substrate 9 and the buffer thin plate 29 formed of a material other than the semiconductor substrate is set to L3. In this configuration, since the length of the bonding margin is relatively set in an order such that the ink tank substrate 12 and the liquid supply substrate 7 formed of the semiconductor substrate having excellent adhesiveness are bonded to each other, the liquid supply substrate 7 and the frame substrate 9 having poor adhesiveness are bonded to each other, and the frame substrate 9 and the buffer thin plate 29 having poor adhesiveness are bonded to each other, a sealing property between the substrates may be ensured while realizing a decrease in size and a reduction in cost.

Further, according to the embodiment, the nozzle cover 27 is provide to cover at least each end of the nozzle substrate 1, the ink tank substrate 12, the liquid supply substrate 7, and the frame substrate 9, and the nozzle cover 27 has a slope provided to correspond to a step-shaped slope formed by at least the edges of the nozzle substrate 1, the ink tank substrate 12, and the liquid supply substrate 7. Accordingly, even in the configuration in which the sheet is conveyed to the end of the head body without substantially increasing the head body, it is possible to prevent the head body from colliding with the sheet which is being conveyed and convey the sheet to a predetermined recording position by using the large chamfered portion formed at the nozzle cover 27.

Further, according to the embodiment shown in FIGS. 7A to 10, sine the inkjet head with the above-described configuration is applied to the liquid ejecting device and the image forming apparatus (the inkjet printer), the device and the apparatus may be decreased in size and be manufactured at low cost.

According to the embodiments, the driving circuit member is provided to correspond to a region between two adjacent nozzle rows located at the 4N+2-th position and the 4N+3-th position (N is 0 or a positive integer) in the arrangement direction intersecting the longitudinal direction of the nozzle row. Accordingly, the driving circuit member may drive the plurality of electro-mechanical converting elements from a position comparatively near to the plurality of electro-mechanical converting elements driven by the driving circuit member and corresponding to the two nozzle rows. Furthermore, the driving circuit member is used to commonly drive not only the electro-mechanical converting element used for the two nozzle rows, but also the electro-mechanical converting element used for another one or two nozzle rows adjacent to at least one of the two nozzle rows. Therefore, one driving circuit member may drive the plurality of electro-mechanical converting elements used for three or four nozzle rows, and a decrease in size and a reduction in cost may be realized compared to the case where the driving circuit member is provided for each nozzle row. Furthermore, the common ink tank communicating with each liquid supply path is formed in the frame substrate different from the ink tank substrate having the electro-mechanical converting element, and the driving circuit member is provided to face the outer surface of the frame substrate provided with the common ink tank. Accordingly, since the common ink tank may be formed in the frame substrate without considering the interference with the electro-mechanical converting element or the driving circuit member; the capacity of the common ink tank is not easily limited by the electro-mechanical converting element or the driving circuit member. Therefore, a decrease in size and a reduction in cost may be realized while ensuring the capacity of the common ink tank.

Further, according to the embodiments, in the bonding margins between the plurality of sequentially laminated substrates, the length of the bonding margin between substrates at least one of which is formed of a semiconductor substrate is set to be shorter than the length of the bonding margin between substrates formed of a material other than the semiconductor substrate. Accordingly, the length of the bonding margin between the semiconductor substrates with excellent adhesiveness is set to be relatively short to realize a decrease in size and a reduction in cost, and the length of the bonding margin between the substrates formed of a material other than the semiconductor substrate and having poor adhesiveness is set to be relatively long to ensure a sealing property between the substrates. Therefore, a decrease in size and a reduction in cost may be realized while ensuring a sealing property between laminated substrates as a whole.

However, in the configurations disclosed in Japanese Patent Application Laid-open No. 2005-349712 and Japanese Patent No. 3988042 and Japanese Patent No. 3580363, since the driving IC or the piezoelectric element is formed on the layer that is flush with the reservoir or the ink pool chamber as the common ink tank, there is a concern in that the capacity of the common ink tank may not be sufficiently ensured. It is desirable that the common ink tank have a larger volume to alleviate cross-talk or the like, and the common ink tank needs a volume for ensuring a supply amount (for example, the maximal flow rate is obtained when ejecting an ink from all channels at the same time) of ink to each ink tank. When the supply amount of the ink to each ink tank is small, the driving frequency inevitably decreases, which affects characteristics of the head. In consideration of this, the common ink tank needs to be provided in the larger size. As a result, there are problems in that a decrease in size of the inkjet head is difficult and cost increases.

Further, the inkjet head includes a plurality of substrates formed of various materials and bonded and adhered to each other. Since leakage or the like of an ink is not allowed in the bonding and adhering operations, a sealing property needs to be ensured with priority. For this reason, for example, the bonding margin between the nozzle substrate provided with the nozzle and the ink tank substrate provided with the ink tank communicating with the nozzle needs to be as long as possible; but this demand is contrary to a decrease in size and a reduction in cost. On the other hand, adhering reliability may be different depending on the condition such as an adhering subject and an adhesive, but in general, is dependent on flatness of a material, surface roughness, surface cleanness, surface energy, and the like. When flatness, surface roughness, and surface cleanness are poor, adhesiveness is degraded. Further, when surface energy is small, wettablity is poor and adhesiveness is also degraded. For example, the surface formed of a silicon substrate having excellent flatness, surface roughness, and the like has good adhesiveness, and even when the bonding margin is very small, a sealing property may be ensured without any difficulty. On the other hand, since a polyimide film or the like has small surface energy, adhesiveness is weak. For this reason, a surface treatment needs to be performed in advance or a bonding margin needs to be long. Further, metal such as a stainless plate has comparatively high surface energy, but has poor flatness when it is manufactured by pressing. For this reason, a sealing property is ensured by setting the bonding margin to be long. In considering the entire inkjet head, the length of the bonded substrate is determined depending on a material having a poor sealing property, a long bonding margin. For this reason, the length of each of laminated substrates is equal to that of the reference substrate. In particular, since the expensive ink tank substrate and the expensive liquid supply substrate increase in size, cost largely increases.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid droplet ejecting head comprising sequentially in a laminated manner:

a nozzle substrate including a plurality of nozzles;

an ink tank substrate including a plurality of ink tanks respectively communicating with the nozzles, vibration plates each forming a part of each ink tank, and a plurality of electromechanical converting elements integrally formed with the vibration plates, respectively so as to correspond to the ink tanks, respectively;

a liquid supply substrate including a plurality of liquid supply paths respectively supplying a liquid to the ink tanks; and a frame substrate including common ink tanks communicating with each liquid supply path, wherein an electrode of a driving circuit member driving the electro-mechanical converting elements is connected to each electrode of the plurality of the electro-mechanical converting elements through an interconnection member;

the nozzle substrate is formed so that at least three or more nozzle rows, each nozzle row including the plurality of nozzles, are arranged in a direction intersecting a longitudinal direction of the nozzle row;

the driving circuit member is provided to oppose to an outer surface of the frame substrate so as to correspond to a region between two adjacent nozzle rows located at the 4N+2-th position and the 4N+3-th position (N is 0 or a natural number) in an arrangement direction among the plurality of nozzle rows arranged in the direction intersecting the longitudinal direction of the nozzle row; and the driving circuit member is commonly used to drive the electro-mechanical converting element used for the two nozzle rows and to drive the electro-mechanical converting element used for another one or two nozzle rows adjacent to at least one of the two nozzle rows.

2. The liquid droplet ejecting head according to claim 1, wherein the ink tank of the ink tank substrate, the liquid supply path of the liquid supply substrate, and the common ink tank of the frame substrate respectively corresponding to the two nozzle rows are respectively provided to overlap each other on a region obtained by projecting the driving circuit member onto each of the ink tank substrate, the liquid supply substrate, and the frame substrate.

3. The liquid droplet ejecting head according to claim 1, wherein the interconnection member connecting the electrode of the driving circuit member to each electrode of the plurality of electro-mechanical converting elements is disposed to run through an opening that passes through the liquid supply substrate.

4. The liquid droplet ejecting head according to claim 1, wherein the driving circuit member is provided to oppose to an outer surface of the frame substrate with a printed circuit board interposed therebetween.

5. The liquid droplet ejecting head according to claim 1, wherein a buffer thin plate and a thin film frame substrate are further laminated on the frame substrate at the opposite side of the liquid supply substrate;

the driving circuit member is bonded to the thin film frame substrate; and the interconnection member connecting the electrode of the driving circuit member to each electrode of the plurality of electro-mechanical converting elements is disposed to run through an opening that passes through the liquid supply substrate, the frame substrate, the buffer thin plate, and the thin film frame substrate.

6. The liquid droplet ejecting head according to claim 1, wherein the nozzle substrate is formed so that four or eight nozzle rows are arranged.

7. The liquid droplet ejecting head according to claim 1, wherein the liquid droplet is an ink droplet used to form an image.

8. A liquid droplet ejecting device comprising:

the liquid droplet ejecting head according to claim 1.

9. The liquid droplet ejecting head according to claim 2, wherein the plurality of liquid supply paths and the plurality of common ink tanks corresponding to the two nozzle rows respectively are adjacent to each other with one partition wall interposed therebetween.

10. The liquid droplet ejecting head according to claim 6, wherein eight nozzle rows are provided in the nozzle substrate; and the plurality of liquid supply paths and the plurality of common ink tanks corresponding to two adjacent nozzle rows located at the fourth and fifth positions in the arrangement direction of the nozzle rows respectively are adjacent to each other with one partition wall interposed therebetween.

11. An image forming apparatus comprising:

a liquid droplet ejecting device including the liquid droplet ejecting head according to claim 7.

12. A liquid droplet ejecting head comprising sequentially in a laminated manner:

a nozzle substrate including a plurality of nozzles;

an ink tank substrate including a plurality of ink tanks respectively communicating with the nozzles, vibration plates each forming a part of each ink tank, and a plurality of electro-mechanical converting elements integrally formed with the vibration plates, respectively so as to correspond to the ink tanks, respectively;

a liquid supply substrate including a plurality of liquid supply paths respectively supplying a liquid to the ink tanks; and a frame substrate including common ink tanks respectively communicating with each liquid supply path, wherein an electrode of a driving circuit member driving the electro-mechanical converting elements is connected to each electrode of the plurality of the electro-mechanical converting elements through an interconnection member; and in the bonding margins between the plurality of sequentially laminated substrates, a length of the bonding margin between substrates at least one of which is formed of a semiconductor substrate is set to be shorter than a length of the bonding margin between substrates which are formed of material other than the semiconductor substrate.

13. The liquid droplet ejecting head according to claim 12, wherein a relation of $L1 \leq L2$ is satisfied when the length of the bonding margin between the ink tank substrate formed of the semiconductor substrate and the liquid supply substrate formed of the semiconductor substrate or a material other than the semiconductor substrate is set to L1, and the length of the bonding margin between the liquid supply substrate and the frame substrate formed of a material other than the semiconductor substrate is set to L2.

14. The liquid droplet ejecting head according to claim 12, further comprising:

a cover member that covers at least each end of the nozzle substrate, the ink tank substrate, the liquid supply substrate, and the frame substrate, wherein the cover member includes a slope corresponding to a step-shaped slope formed by at least edges of the nozzle substrate, the ink tank substrate, and the liquid supply substrate.

15. The liquid droplet ejecting head according to claim 12, wherein the liquid droplet is an ink droplet used to form an image.

16. A liquid droplet ejecting device comprising:

the liquid droplet ejecting head according to claim 12.

17. The liquid droplet ejecting head according to claim 13, wherein a buffer thin plate and a thin film frame substrate are further laminated on the frame substrate at the opposite side of the liquid supply substrate; and a relation of $L1 \leq L2 \leq L3$ and $L1 < L3$ is satisfied when the length of the bonding margin between the frame substrate and the buffer thin plate formed of a material other than the semiconductor substrate is set to L3.

18. An image forming apparatus comprising:

a liquid droplet ejecting device including the liquid droplet ejecting head according to claim 15.

* * * * *